United States Patent [19]

Vanderpool

[11] 3,982,377

[45] Sept. 28, 1976

[54] AUTOMATIC BAGGING MACHINE

[75] Inventor: Charles C. Vanderpool, Waverly, N.Y.

[73] Assignee: BMT Manufacturing Corporation, Elmira, N.Y.

[22] Filed: May 7, 1974

[21] Appl. No.: 467,679

Related U.S. Application Data

[63] Continuation of Ser. No. 141,882, May 10, 1971.

[52] U.S. Cl. ..... 53/66; 53/241; 53/256; 53/253; 156/253; 156/513; 211/1.5

[51] Int. Cl.[2] ..... B65B 57/00; B65B 43/30

[58] Field of Search ..... 53/183, 241, 256, 253, 53/391, 66; 211/1.5, 163; 156/253, 513

[56] References Cited

UNITED STATES PATENTS

| | | | |
|---|---|---|---|
| 3,112,586 | 12/1963 | Luetzow | 53/241 X |
| 3,115,564 | 12/1963 | Stacy | 156/513 |
| 3,308,601 | 3/1967 | Masters | 53/241 X |
| 3,338,420 | 8/1967 | McClenny et al. | 211/1.5 |
| 3,621,638 | 11/1971 | Grocke | 53/183 X |
| 3,676,980 | 7/1972 | Engelhardt et al. | 53/386 X |

*Primary Examiner*—Travis S. McGehee
*Attorney, Agent, or Firm*—Charles S. McGuire

[57] ABSTRACT

Apparatus for automatically covering an item, such as a garment on a hanger, with a bag closed at the top and sides, and open at the bottom. The bagging material is supplied from a continuous roll in tubular form and is automatically fed from the roll, pulled over the item, cut to the proper length for the item to be covered, and heat sealed along the top edge. Unique means are provided for holding, cutting and sealing the bagging material, preferably a thermosensitive plastic, as well as for re-opening the end after cutting to begin a new cycle. Three stations for holding items to be covered, i.e., loading, bagging and discharge stations, are positioned on a rotating base and automatically indexed through each position in a continuous manner as the operations are performed.

29 Claims, 28 Drawing Figures

PHOTOCELL LENGTH DET.
202
PHOTOCELL PRESENCE DET.
277
TABLE MOTOR
90
AIR SOL TABLE INDEX
265
TABLE INDEX
58
CARRIAGE MOTOR
111
MAG. CLUTCH
267
BRAKE
COUNTER
TIME DELAY
250
SWING BAR
57
CHASSIS GND.
OFF
ON
IN
OUT
K1
K2
K3
K4
K5
K6
S1
S2
S3
S4
S5
S6
243
168
242
62
263
275
271
273
262
281
279
260
261
78
77
284
258
128
245
269
61
244
130
254
248
257
256
249
253
251
241
240

AUTOMATIC BAGGING MACHINE

This is a continuation of application Ser. No. 141,882, filed May 10, 1971.

This invention relates to automatic covering or bagging apparatus and is especially directed to automatic means for covering a garment on a hanger with an individual bag, closed at the top and sides, of material supplied in continuous, tubular form.

It is a common practice to package newly manufactured, as well as dry cleaned or laundered garments and other articles in bags closed at the top and sides, and open at the bottom, with the end of a wire hanger, or the like, on which the garment is supported extending through an opening in the top edge of the bag. The bagging material is usually a transparent plastic to allow the article to be seen while still being protectively packaged. Clear polyethylene, for example, is commercially available for this purpose in various thickness, widths and lengths in tubular form, folded flat and supplied in rolls.

The majority of bagging operations are presently performed in a semi-automatic manner, requiring an operator to open the end of the bagging material and manually draw it over the garment. The material may be pre-sealed and perforated at uniform intervals along its length, in which case the operator tears the material manually along the perforation. Alternatively, apparatus may be provided for manual actuation by the operator to provide the sealing and perforation at the desired position. For various reasons, completely automatic bagging equipment has lacked perfection to the point of being acceptable for widespread commercial use.

It is a principal object of the present invention to provide fully automatic equipment for providing bags, closed at the sides and one end, from a supply of tubular material, and placing such bags over articles to be covered in a continuous sequnce.

A further object is to provide fully automatic equipment for drawing the open end of a tubular bagging material over a sequence of articles to be covered thereby and automatically sealing and cutting the material laterally to form a bag closed at one end and having a length as desired, in constant relation to the length of the articles, regardless of variations in the latter.

An additional object is to provide apparatus which will accept a continuous supply of individual articles, fabricate a bag closed at the sides and one end from a continuous web of tubular material, place the bag over the articles, and eject the latter to a conveyor or other desired receiving means, all in a fully automatic manner.

Still another object is to provide improved means for automatically opening and holding open the end of a continuous web of tubular material while drawing the latter over an article to form a bag enclosing same.

Additional objects are: to provide, in a machine of the character described, improved mechanism for automatically indexing a plurality of stations through a continuous operating sequence with variable dwell time; to provide improved automatic heat sealing apparatus for providing a lamination with spaced perforations in a length of polyethylene plastic or the like; to provide extremely simple yet effective automatic braking means for a roll of film material supported for free rotation as it is intermittently pulled from the roll; and to provide mechanism of the class described having novel safety and interlock features.

The above and other novel features of the invention will appear more fully hereinafter from the following detailed description when taken in conjunction with the accompanying drawings. It is expressly understood that the drawings are employed for purposes of illustration only and are not designed as a definition of the limits of the invention, reference being had for this purpose to the appended claims.

In the drawings, where like reference characters indicate like parts:

Figure 7A:
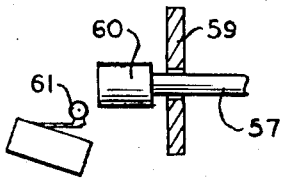
FIG. 7 is a side elevation of certain elements shown in FIG. 6.
Figure 7:
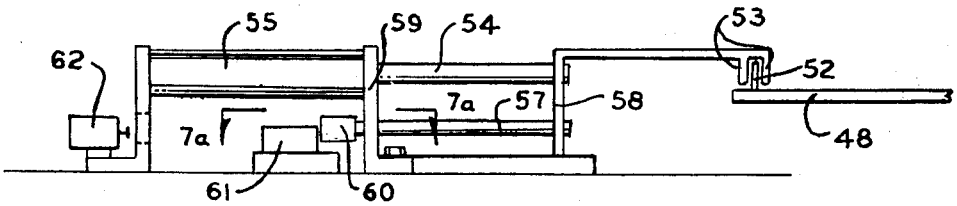
Figure 8A:
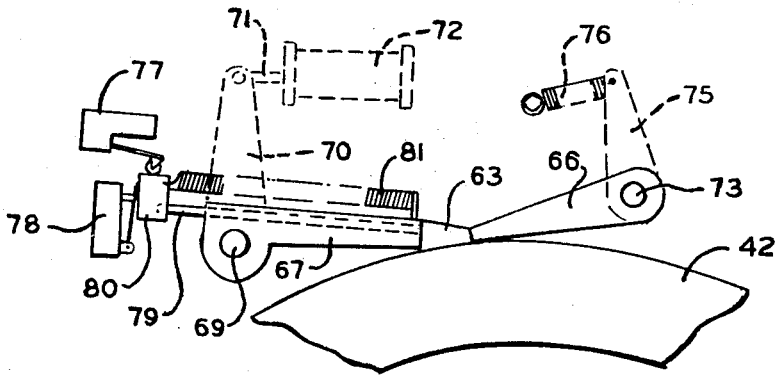
Figure 8B:
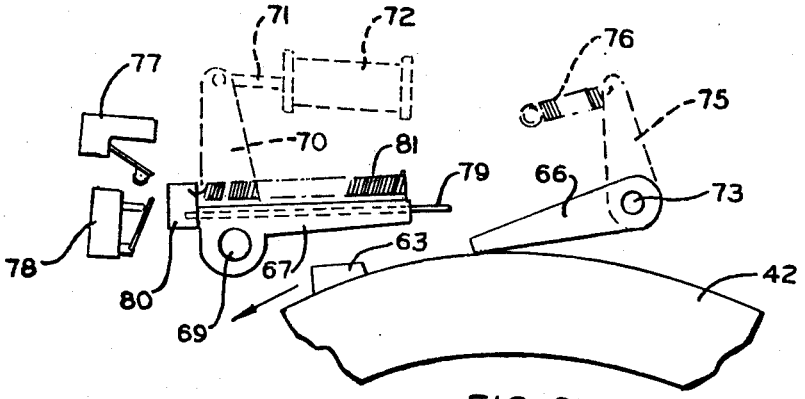
Figure 8C:
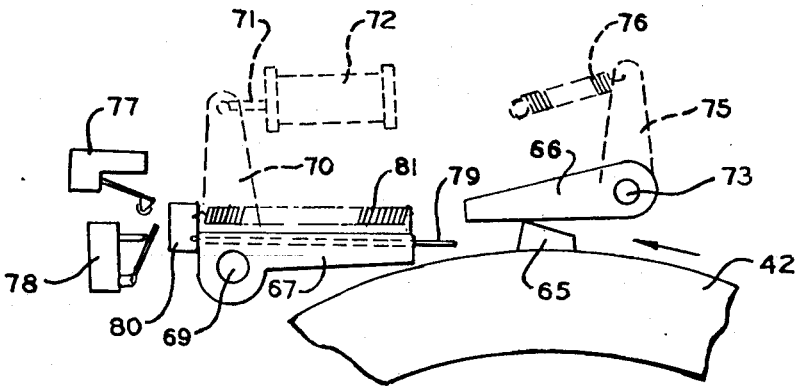
Figure 9:
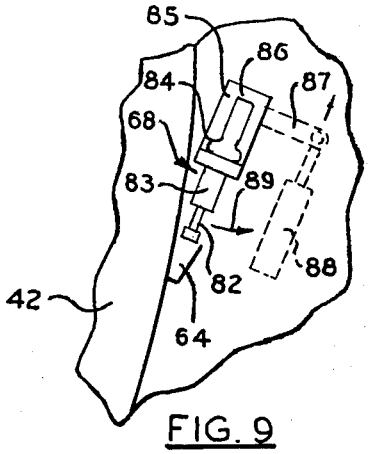
Figure 10:
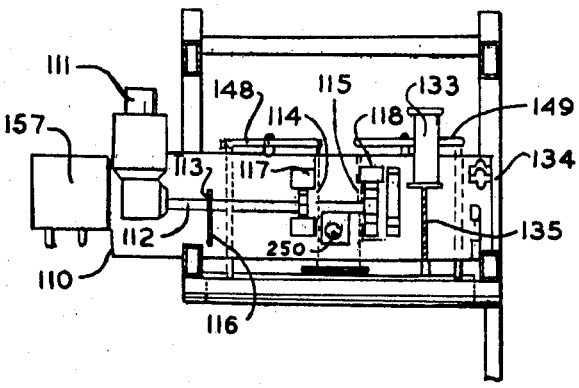
Figure 11:
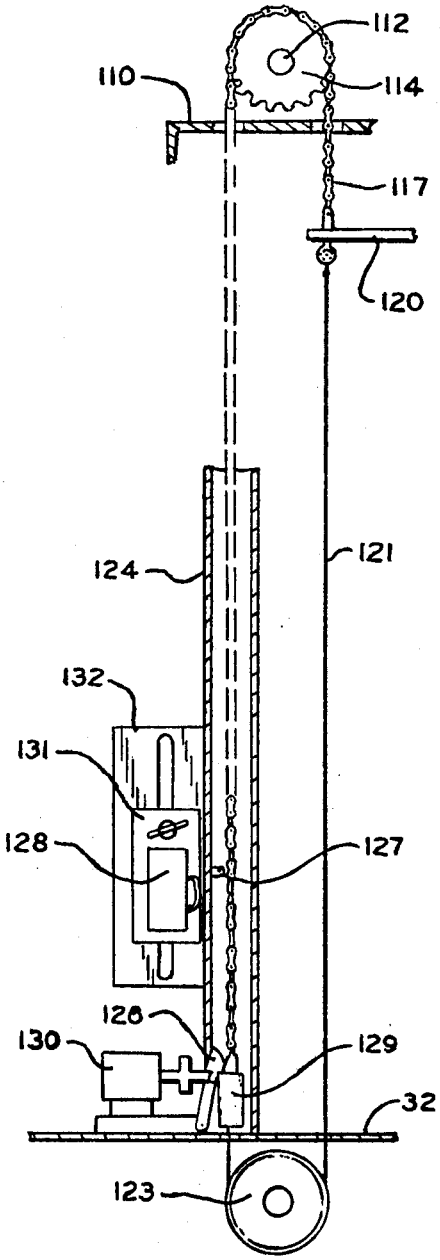
Figure 12:
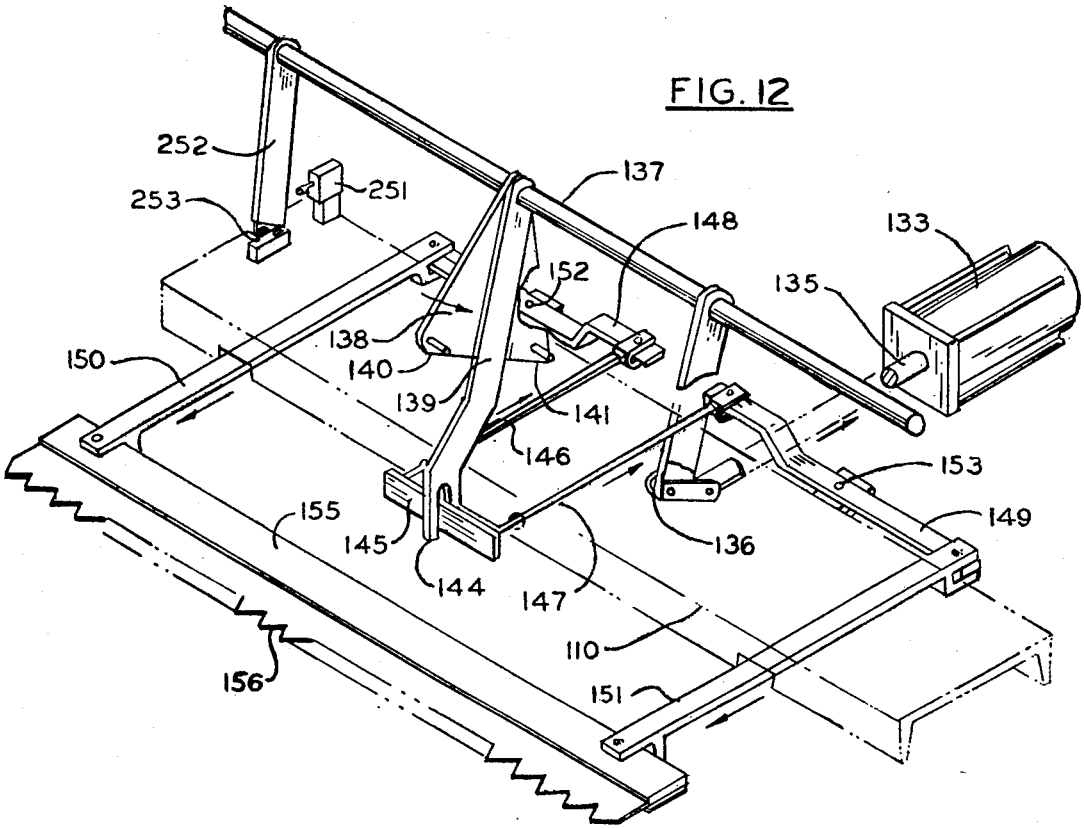
Figure 13:
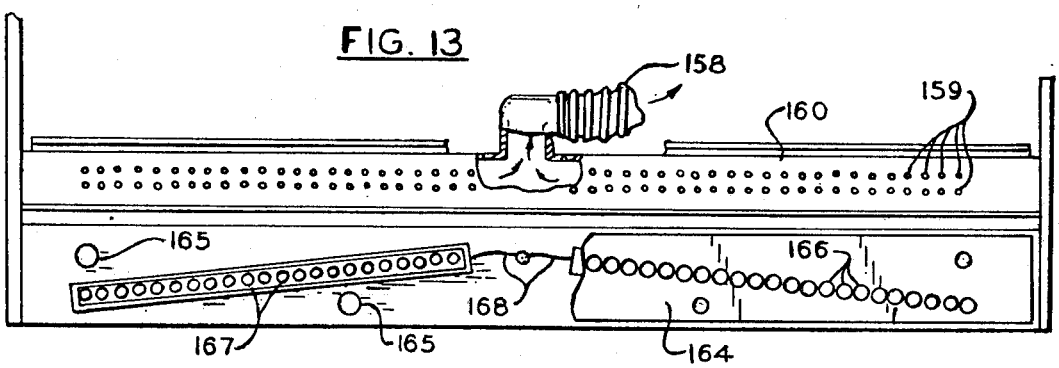
Figure 20:
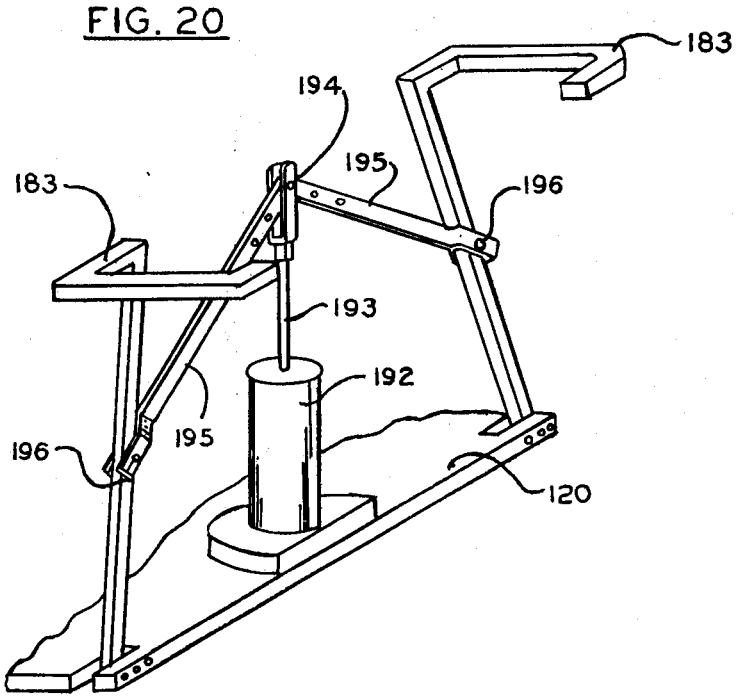
Figure 12A:
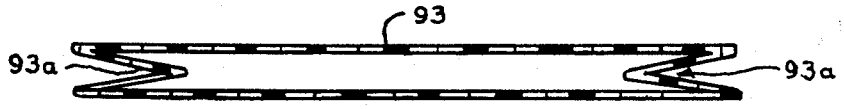
Figure 14:
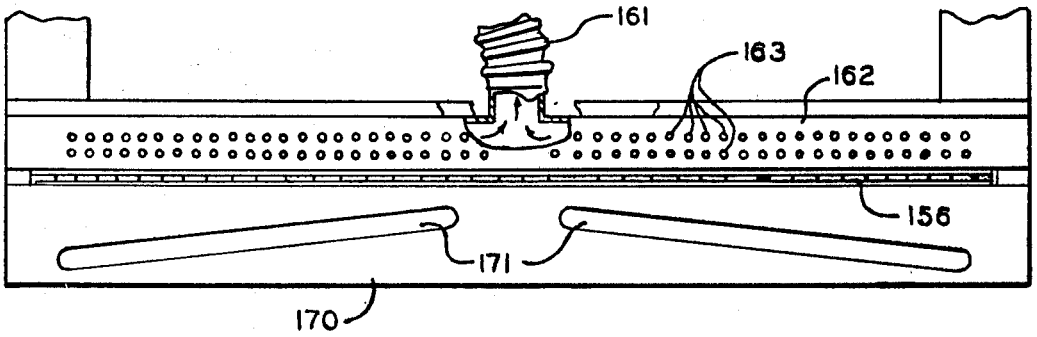
Figure 15:
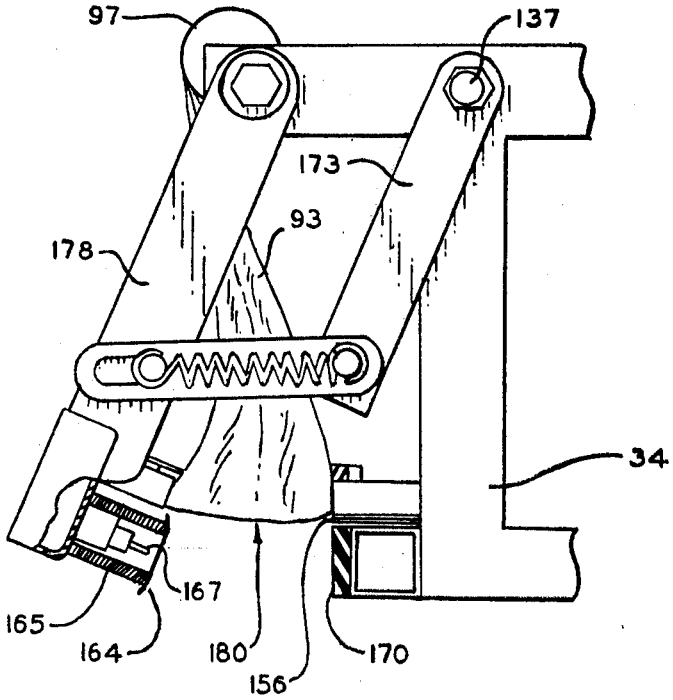
Figure 16:
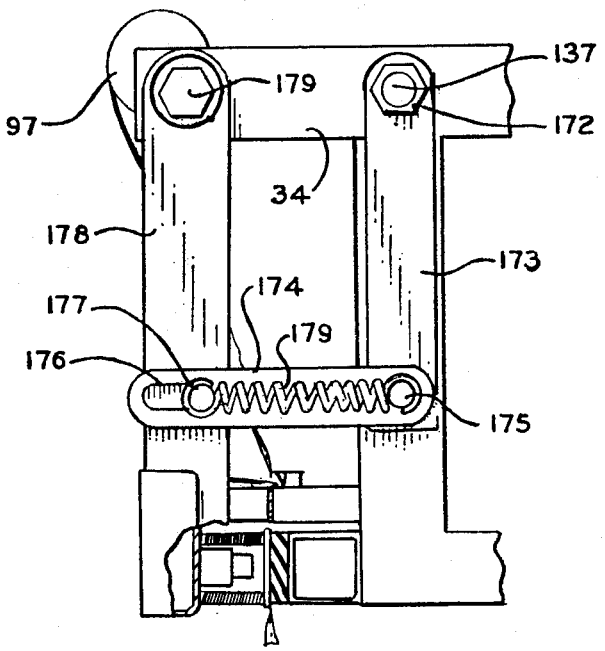
Figure 17:
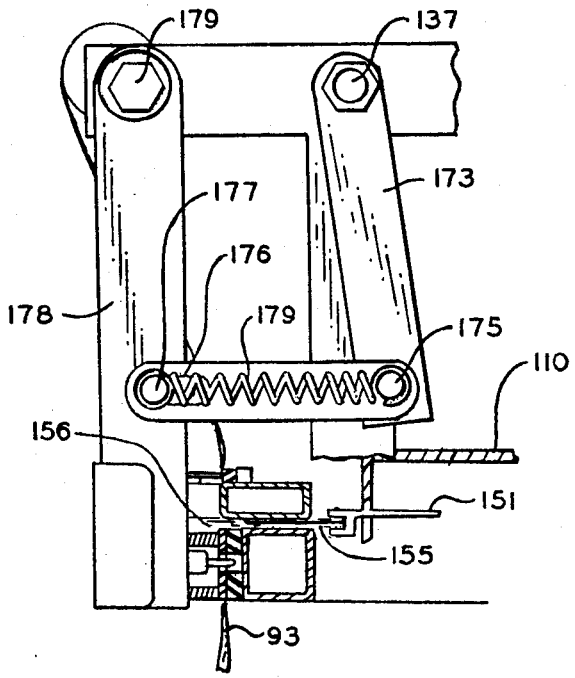
Figure 18:
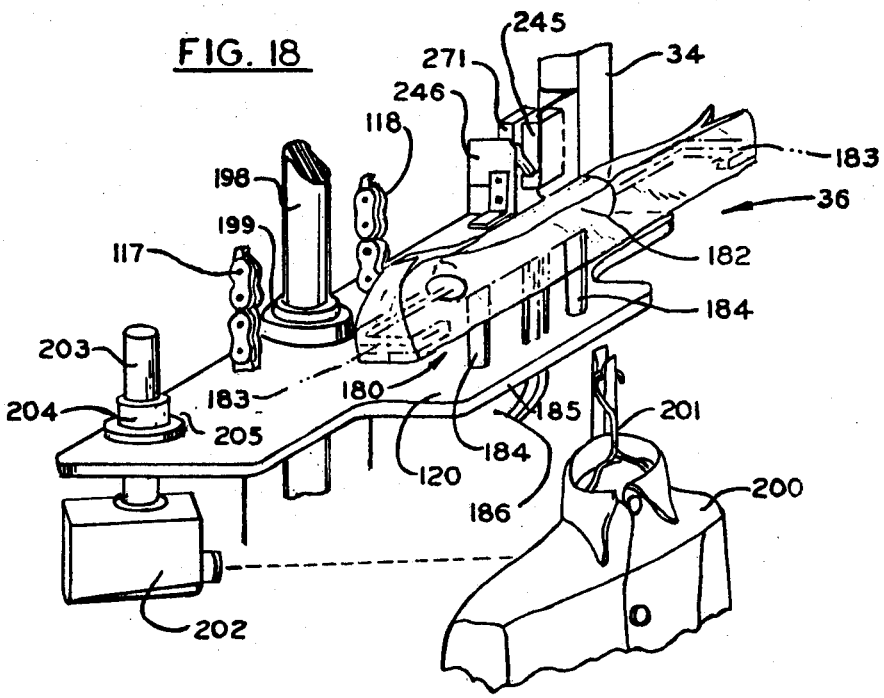
Figure 19:
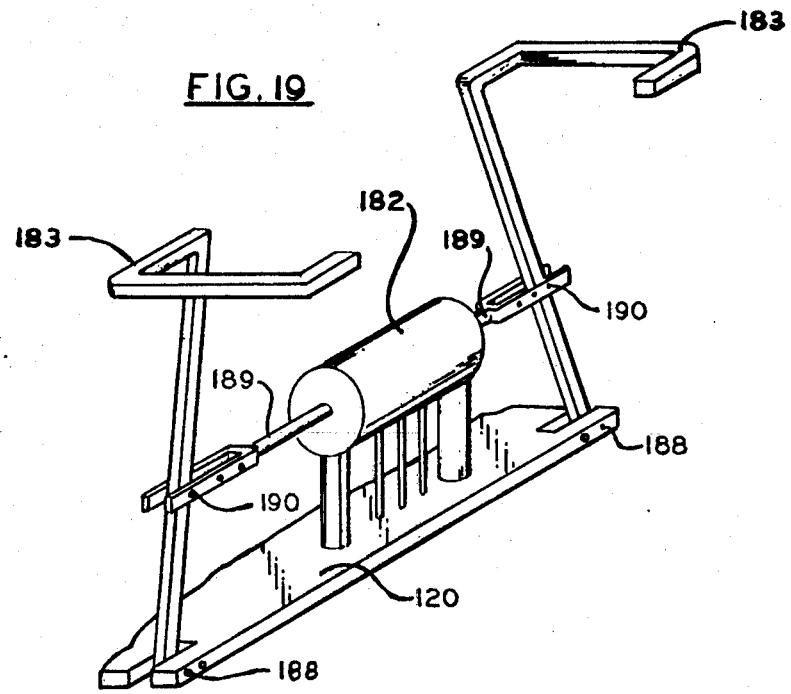
Figure 21:
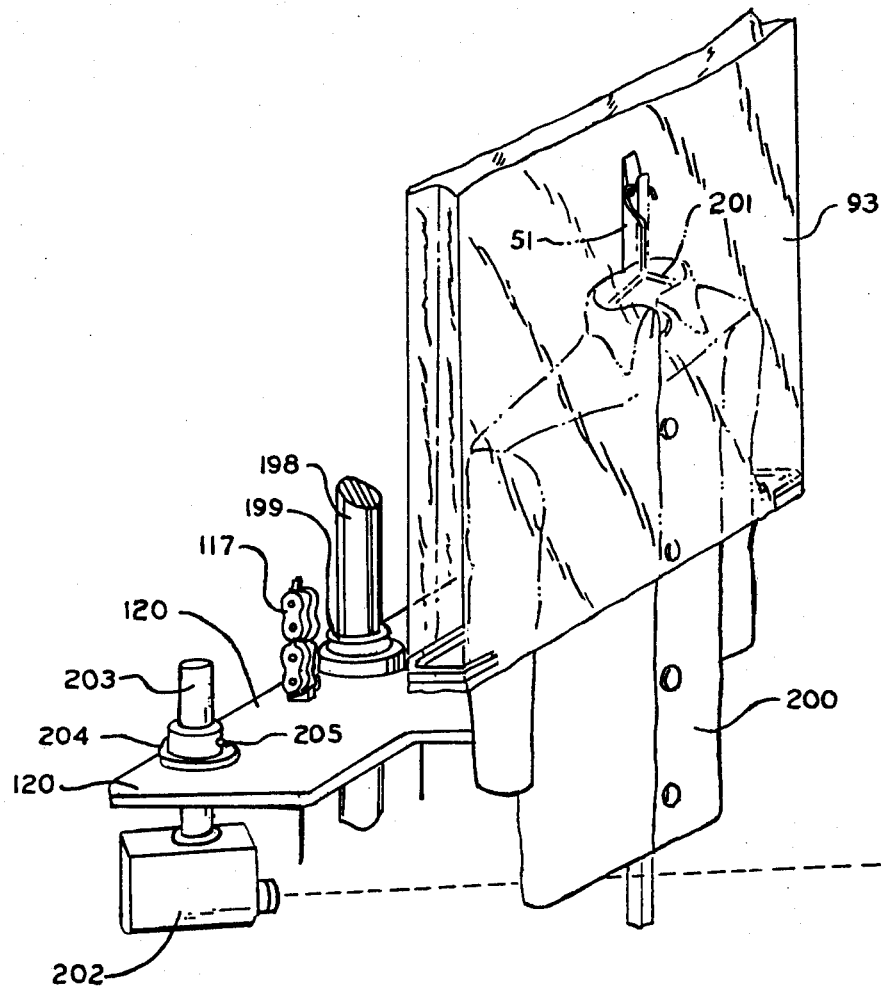
Figure 22:
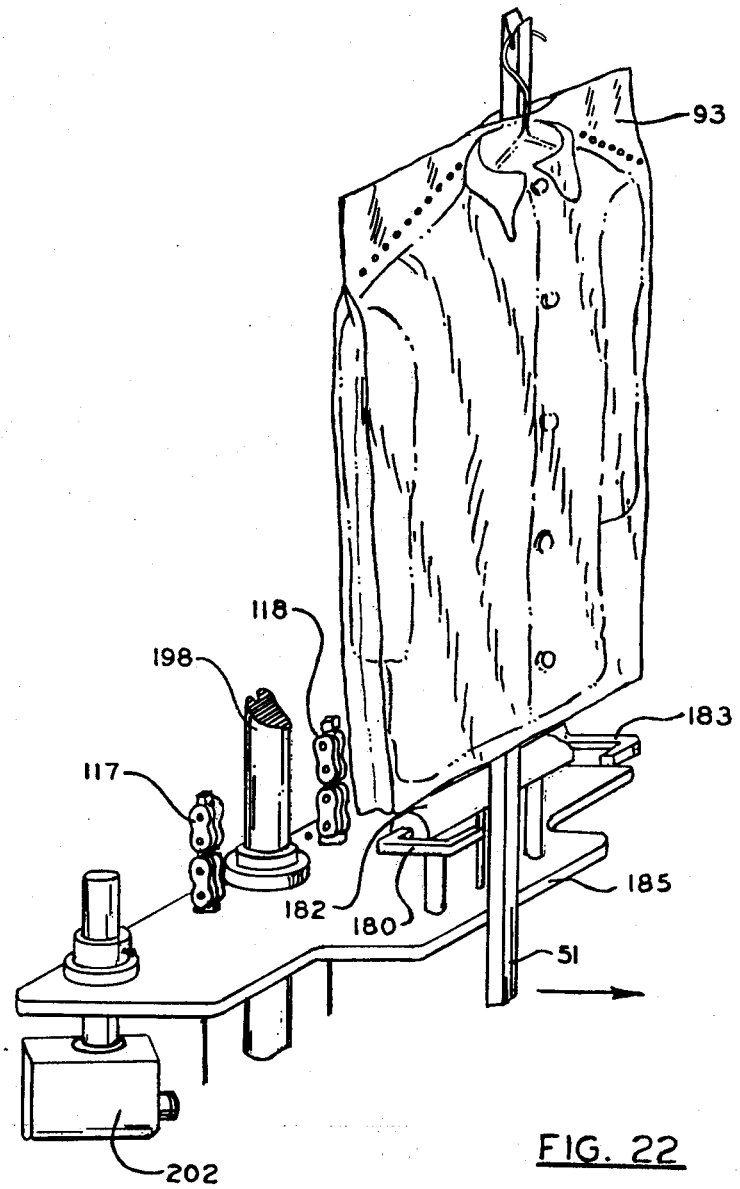
Figure 23:
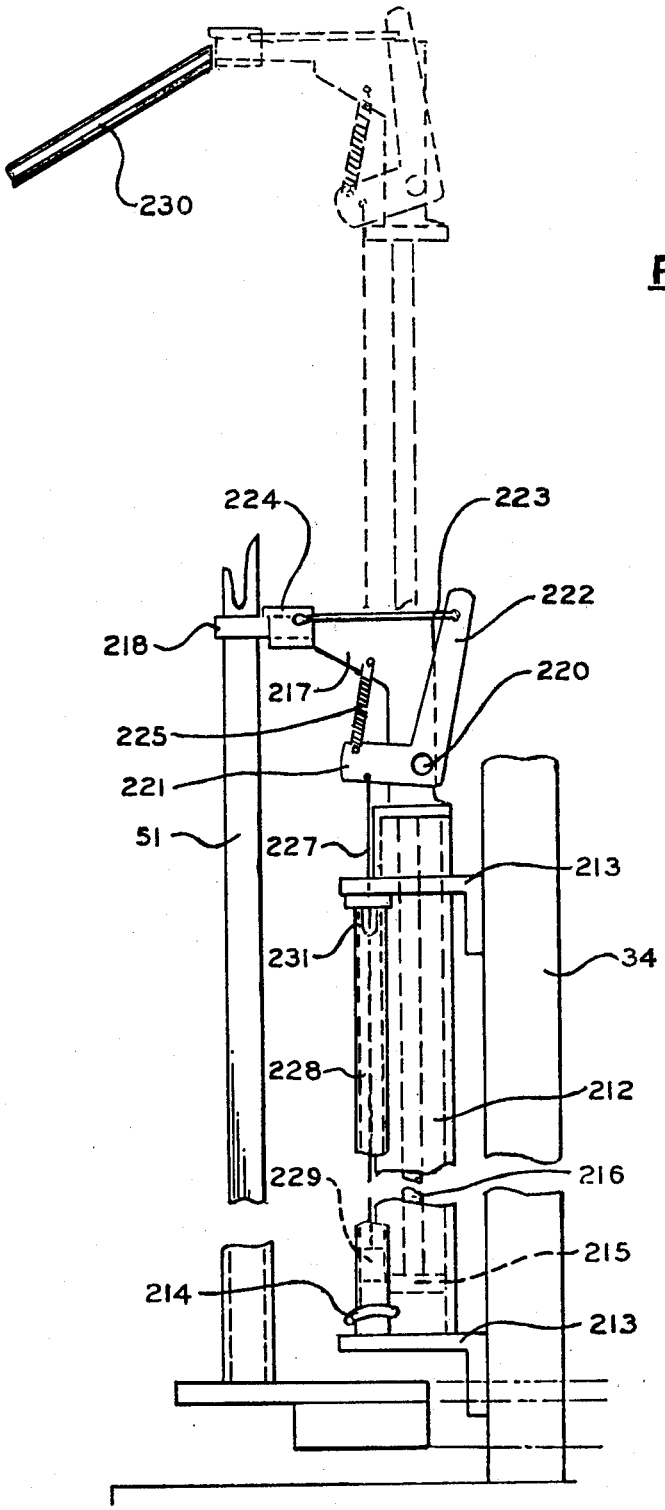
Figure 24:
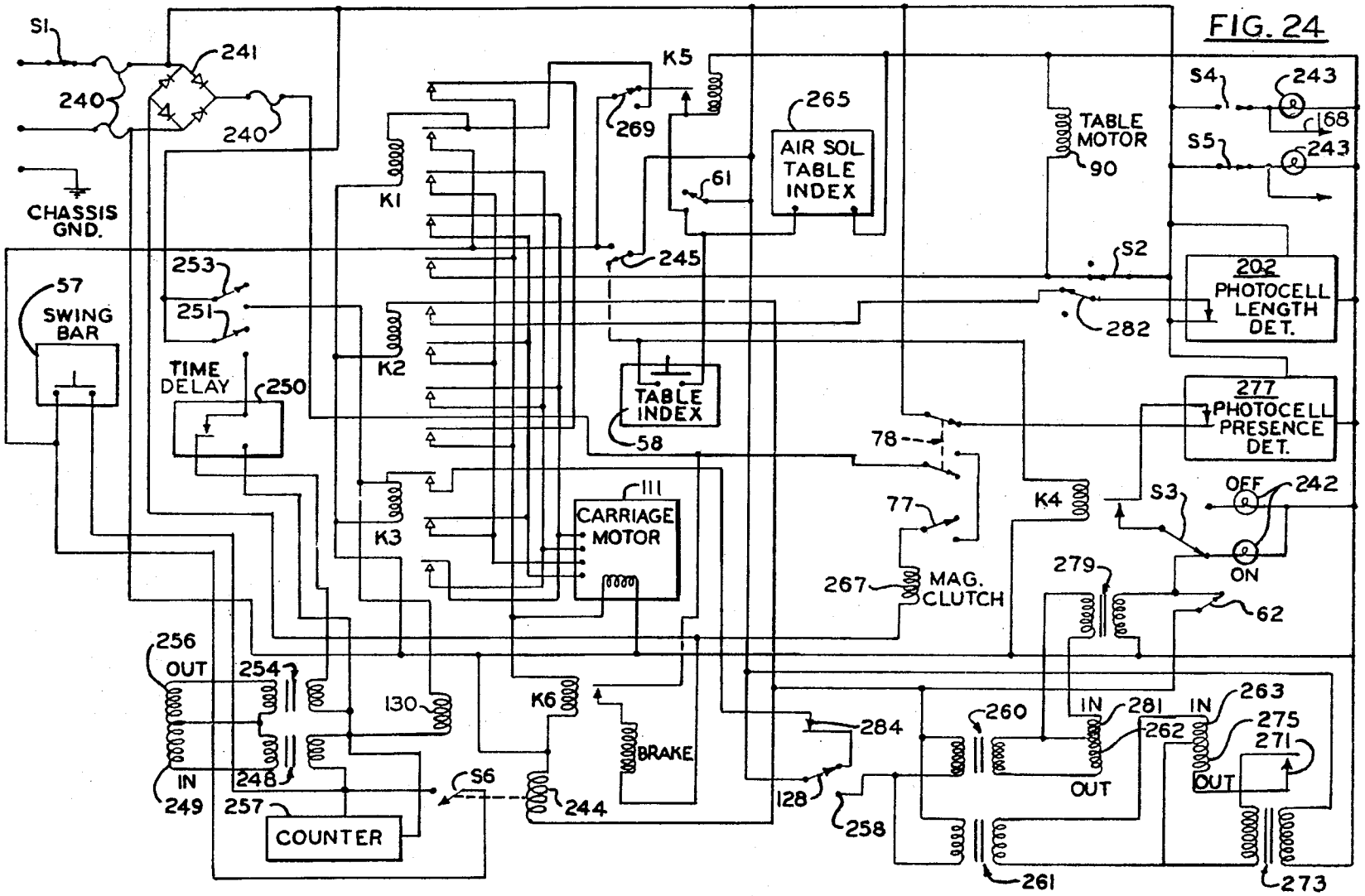

FIG. 7*a* is a fragmentary view as seen from line 7*a*—7*a* of FIG. 7;

FIGS. 8*a*, 8*b* and 8*c* are a sequence of plan views showing the various positions of relative movement of the position indexing mechanism;

FIG. 9 is a detail of the shock absorber mechanism for the position index;

FIG. 10 is a plan view of an upper portion of the apparatus;

FIG. 11 is a side elevation, partly in section, of portions of the carriage drive mechanism;

FIG. 12 is a detailed, perspective view of the knife blade actuating mechanism;

FIG. 12*a* is a sectional view of the tubular bagging material;

FIG. 13 is a front elevation, partly in section, of one face of the reciprocating mechanism for engaging, sealing and cutting the bagging material;

FIG. 14 is a front elevation of the face opposing that shown in FIG. 13;

FIGS. 15–17 are fragmentary, side elevations, partly in section, of the mechanisms for moving the reciprocating faces shown in FIGS. 13 and 14, showing the sequence of operation thereof;

FIG. 18 is a fragmentary, perspective view of the vertically reciprocating carriage, shown in the uppermost position, with an article positioned for bagging;

FIGS. 19 and 20 are perspective views of additional embodiments of the mechanism for holding open the end of the tubular material;

FIG. 21 is a second perspective view of the elements of FIG 18, shown in an intermediate position travel;

FIG. 22 is another perspective view of the same elements, showing the carriage in the lowermost position;

FIG. 23 is a fragmentary elevational view showing the automatic ejection mechanism in two positions; and FIG. 24 is an electrical schematic showing electrical operation of the system.

Although the apparatus of the invention is suitable for use in a variety of applications, it will be shown and described in connection with an operational cycle wherein a continuous supply of garments suspended on conventional wire hangers are provided with enclosing plastic bags and automatically ejected to a conveyor. The bagging material is supplied in the form of a continuous web of tubular stock (i.e., an elongated double layer, closed at the sides), folded flat with side gussets, in accordance with conventional practice. The material itself forms no part of the present invention, but is operated on by the apparatus thereof and is therefore described in some detail. Preferably, the material is initially provided in roll form and comprises a transparent, heat sensitive plastic, such as polyethylene normally supplied in ½ or 1 mil thicknesses, and will hereafter be referred to as such.

Movable portions of the apparatus are driven by electric motors, and actuation of certain elements is accomplished through relays, solenoids, microswitches, and the like. Accordingly, certain operating portions of the apparatus are connected through electrical cable 30, to control cabinet 31, the latter being provided with appropriate manual control knobs, switches, etc., and connected to an appropriate power source. Control cabinet 31 may conveniently be physically separated from the operating portion of the apparatus, if desired, and the controls for a plurality of such operating portions in widely spaced locations may be centralized for simultaneous control by a single operator.

The apparatus is divided generally into rectangular base portion 32, rotating annular table 33, fixed upright frame 34, reciprocating sealing-cutting unit 35 and vertically traveling carriage 36. Base portion 32 houses at one corner 37 the drive mechanism for rotating table 33, and at a second corner 38 the table indexing mechanism, described in detail in connection with FIGS. 8*a*, *b* and *c*. Also mounted on the base portion are appropriate rollers 39 (FIGS. 2–5) upon which table 33 is rotatably supported. The central part of the base portion 32 (inside the annular rotating table) supports frame 34, horizontally disposed thrust wheels 40 which serve to maintain the lateral position of table 33, and various other elements supported thereon.

Figure 6:
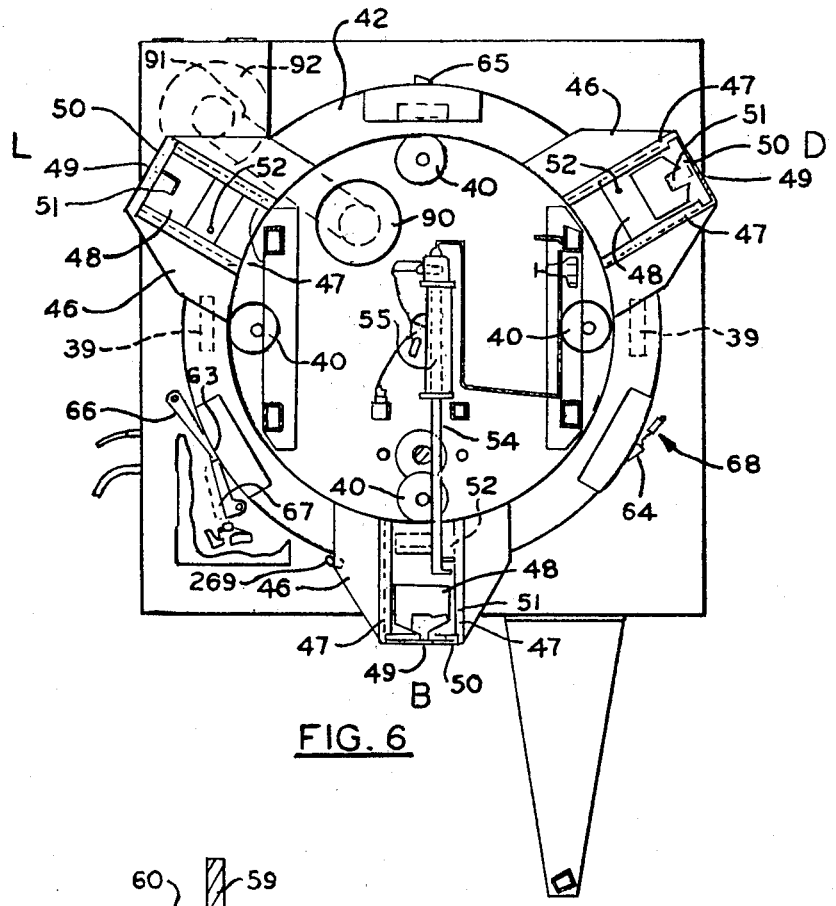
FIG. 6 is a plan view of the lower part of the apparatus.

Table 33 comprises annular ring 42, supported as just described for rotation on base portion 32, having three sliding supports 43, 44 and 45 attached thereto at evenly spaced (120°) intervals. As best seen in FIG. 6, each of the three identical supports includes support plate 46, to which is affixed pair of spaced guide members 47, defining tracks in which slider plates 48 are radially movable with respect to circular table 33. Sliders 48 are releasably retained in the outermost position by conventional magnetic catches 49 on fixed members 50 which extend across the outer ends of the tracks. A vertical post 51 is affixed to each of sliders 48 and has a notched upper end, suitable for accepting the hooked end of a conventional wire clothes hanger.

As best seen in FIG. 7, each of sliders 48 includes a fixed, upstanding stud 52 positioned for movement, as table 33 is rotated, between a pair of downwardly extending fingers 53 on the end of rod 54. The latter is reciprocally movable by control of an air supply to pneumatic cylinder 55, in a manner explained later in detail. A second rod 57 is affixed to bracket 58 which extends rigidly from cylinder rod 54 for movement therewith. Rod 57 extends through an opening in one of the mounting brackets 59 for cylinder 55, thereby preventing rotation of rod 54, and includes end portion 60 for actuation of electrical switch 61 by contact with a movable arm thereof positioned in the path of movement of portion 60. Switch 61 is of the type which, though contacted by portion 60 in both directions of movement of rod 57, is actuated to close the switch contacts in only one direction, in this case the forward stroke. Another switch 62, of the plunger type, is also positioned for contact by end portion 60 which closes the contacts of this switch when rod 57 is at one end of its travel.

At this point it should be mentioned that a number of switches such as 61 and 62, of various conventional types, will be mentioned at various places in the specification. The relative position and manner of mechanical actuation of the switch may be described without immediate reference to its function or the effect of actuation thereof. Likewise, certain other elements may be initially described as movable in a particular manner, e.g., valves, solenoids, motors, etc., without a full accompanying description of all the means providing actuation for such movement. However, a complete disclosure of the cooperative action of all elements, mechanical, electrical and pneumatic, will be provided later in the specification.

Also indicated in FIG. 6 are the means for moving table 33 and for stopping and indexing it in three distinct positions. Securely affixed to the outer periphery of annual ring 42 are three stops 63, 64 and 65. In the position shown in FIG. 6, stop 63 is held between the opposing end portions of two members 66 and 67 rotatably mounted on base portion 32, and stop 64 rests against a shock absorber unit 68, also pivotally mounted on the base and shown in more detail in FIG. 9.

Referring now to FIGS. 8*a–c*, the structure and operating sequence of the indexing mechanism is shown more fully. Index pawl 67 is affixed to pivot shaft 69 which extends through the base portion and is keyed to arm 70 for rotation therewith. Plunger 71 of solenoid 72 is attached to one end of arm 70, whereby actuation of the solenoid serves to rotate arm 70 and pawl 67 to the position of FIG. 8*b*. Table 33 may then be rotated in the direction indicated by the arrow adjacent stop 63.

Member 66 is likewise affixed to a pivot shaft 73 extending through the base portion. Arm 75 is keyed to shaft 73 and biased by spring 76 toward counterclockwise rotation, as shown in FIGS. 8*a–c*. Thus, the end of member 66 will be biased against the outer periphery of ring 42 and will be rotated clockwise by stop 65, as shown in FIG. 8*c*, as the table continues to rotate. In the meantime, deactuation of solenoid 72 will move pawl 67 back to its original position to prevent further forward movement of the table after contact of stop 65 with pawl 67. Member 66 will be biased to rotate behind stop 65 and prevent backward rotation of the table, which will thus be securely indexed in the next desired position.

In addition to the indexing function just described, movement of pawl 67 serves to actuate a pair of switches 77 and 78. Rod 79 passes through an opening in, or is otherwise mounted for axial sliding movement upon, pawl 67. Block 80 is affixed to one end of rod 79 and the latter is biased by spring 81 toward movement to the right as shown in FIGS. 8*a–c*. Thus, rod 79 will be maintained in the position of FIGS. 8*b* and *c* by the force of spring 81 until contact with one of the moving stops. As the stop moves rod 79 rearwardly, switch 77 is actuated by rotation of an extending arm thereof and switch 78 by depression of a plunger.

In FIG. 9 a fragment of annular ring 42 is shown with stop 64 resting against plunger 82 of shock absorber mechanism 68. This mechanism is provided to prevent excessive wear and tear on the parts which would otherwise be caused by the fixed stops on the table hitting indexing pawl 67, which has not resilience. Plunger 82 extends into cylinder 83 and may be spring loaded or have movement into the cylinder opposed by hydraulic or pneumatic dash pot means. Standard units of this type are commercially available and may include means such as nut 84 for adjusting the force opposing movement of the plunger. Mechanism 68 is mounted on support bracket 85 which is affixed to pivot shaft 86. The latter extends through, and serves as a pivotal mounting for the mechanism upon, base portion 32. On the lower side, arm 87 is affixed to shaft 86 for rotation thereof in response to movement of the other end of the arm by actuation of solenoid 88. Thus, solenoid 88 may be actuated to rotate shock absorber mechanism 68 in the direction indicated by arrow 89 to permit movement of the table, and deactuated to return the mechanism to its original position for contact of the next stop with plunger 82. The elements are so positioned, of course, that a stop contacts plunger 82 before a corresponding stop contacts pawl 67 of the indexing mechanism and slows movement of the table sufficiently to avoid damage or excessive shock when a fixed stop does contact pawl 67.

Referring again to FIG. 6, table portion 33 is rotated, when not held in position by the indexing or shock absorber mechanism, by electric motor 90. The latter is mounted on the upper side of base portion 32 and has a shaft extending therethrough to a pulley on the lower side. Belt 91 connects the motor pulley to a friction drive wheel 92 having an outer periphery in contact with ring 42 for imparting rotation thereto. Suitable clutch means (not shown) are provided in conventional manner so that motor 90 will be running whenever the machine is in operation, but the table will rotate only when the clutch is engaged.

Also indicated in FIG. 6, by the letters L, B and D, are the respective stations for loading, bagging and discharge which occur when each garment pole is in that position.

Figure 3:
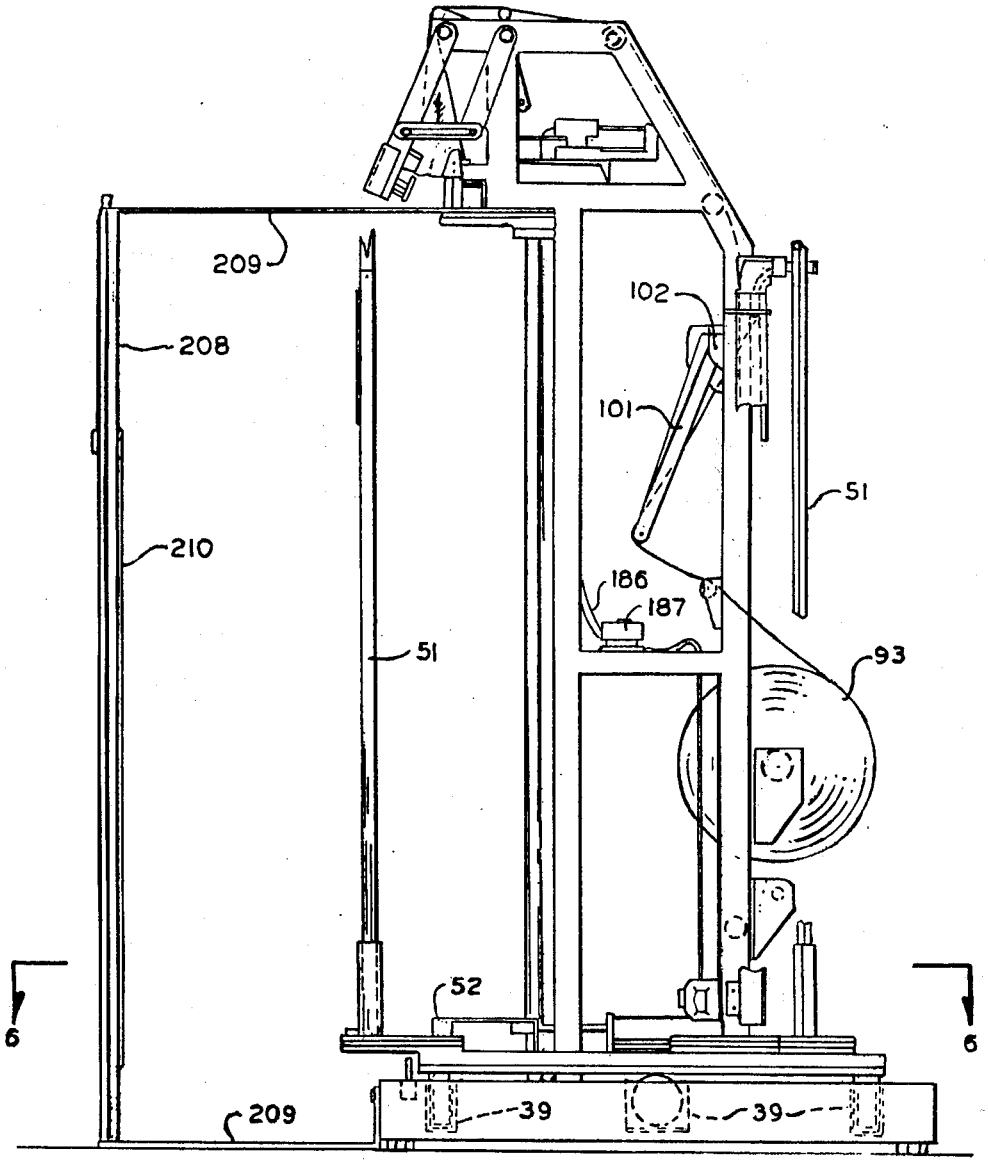
Figure 4:
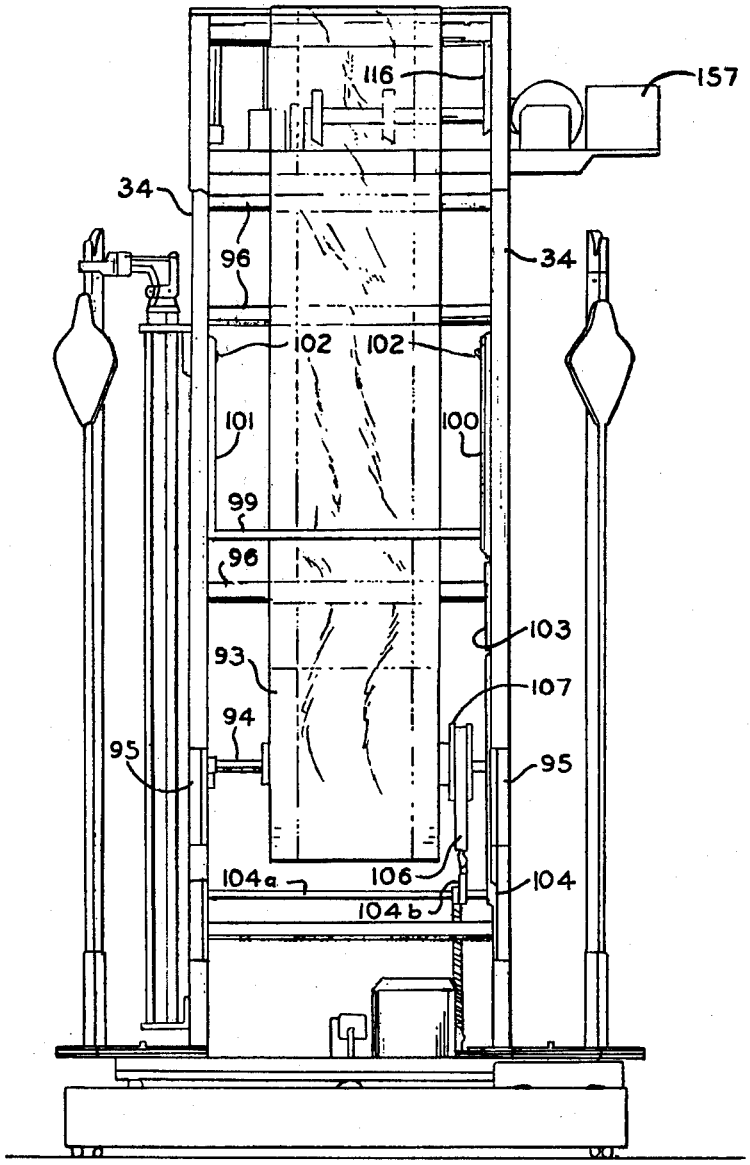
Figure 5:
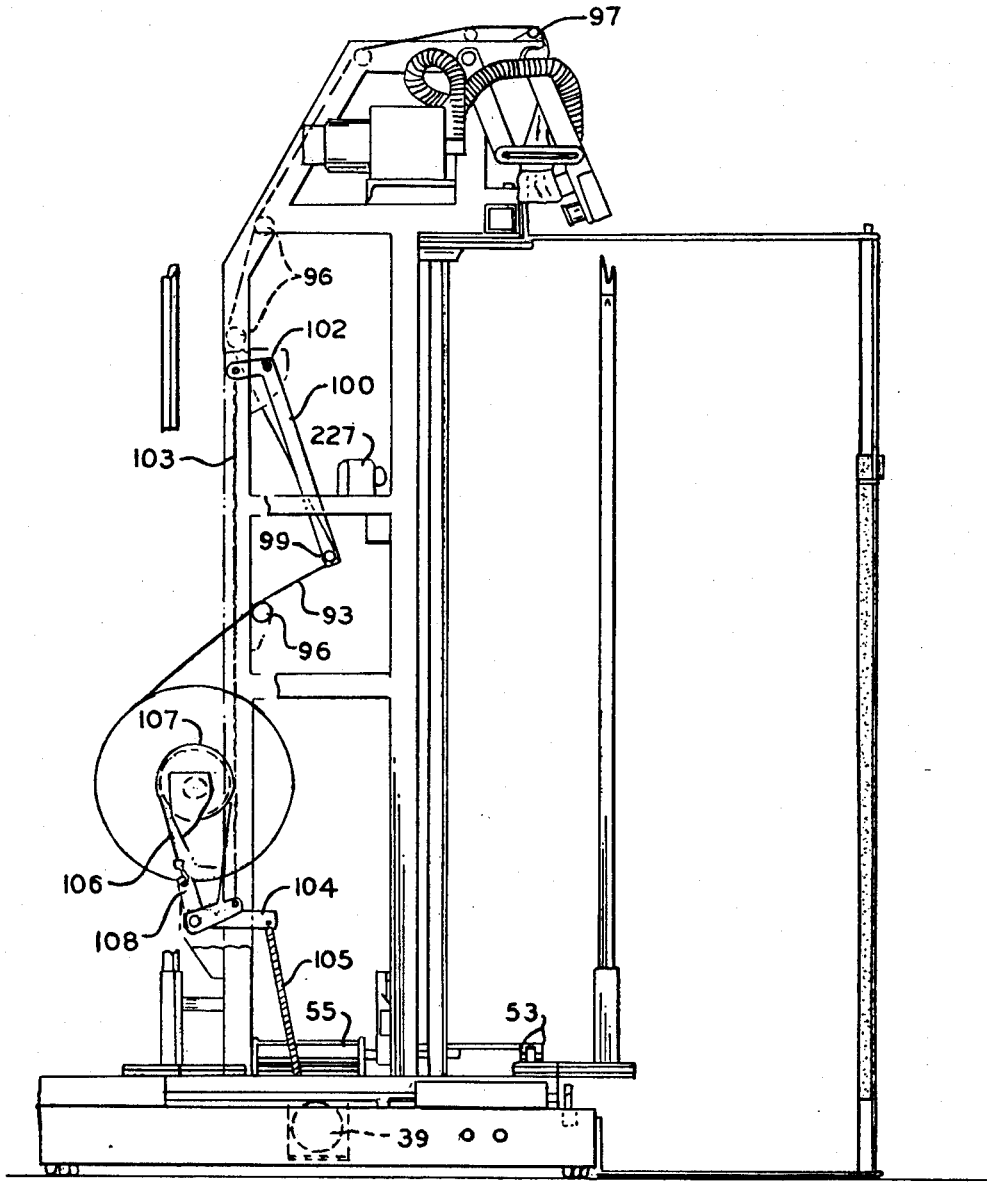

As previously mentioned, the polyethylene bagging material is commercially available in roll form, and is so supplied for use in the present invention. As best seen in FIGS. 3—5, a roll of material 93 is rotatably supported on an axle or spindle 94, having end portions resting on brackets 95 of frame 34. Material 93 passes over an appropriate system of guide rolls 96 and drive roll 97, all supported for rotation between portions of frame 34. Between the first two guide rolls, material 93 passes around bar 99, supported between arms 100 and 101, each pivotally mounted on frame 34 for rotation about pins 102. Chain 103 is affixed at one end to arm 100, on the opposite side of the pivotal mounting thereof from bar 99 (see FIG. 5). The other end of chain 103 is attached to arm 104, extending fixedly from bar 104*a*, rotatably supported on frame 34 and biased toward rotation in a clockwise direction, as seen in FIG. 5, by spring 105. Belt 106 is secured at one end to a second arm 104*b*, also extending fixedly from bar 104*a*, passes around pulley 107 which is secured to spindle 94 for rotation therewith, and is attached at the other end to an appropriate fixed support. As material 93 is pulled from the roll, the force exerted thereon is transmitted to bar 99 and tends to rotate arm 101, as seen in FIG. 3, counterclockwise and arm 100, as seen in FIG. 5, clockwise, thereby pulling chain 103 upward and rotating arm 104 counterclockwise against the biasing force of spring 105. This tends to loosen the frictional engagement of belt 106 with pulley 107, as bar 104*a* and arm 104*b* are also rotated, allowing the roll of material to rotate freely. When the material ceases to be pulled from the roll, it no longer exerts a force on bar 99 and the force of spring 105 tending to rotate bar 104*a* becomes greater than the force of chain 103. Thus, the bar is rotated in the opposite direction, drawing belt 106 more tightly over pulley 107 and inhibiting rotation of the roll of material 93. An effective friction braking means is thereby provided which responds automatically to demand for material and prevents unwanted slack from developing.

Figure 1:
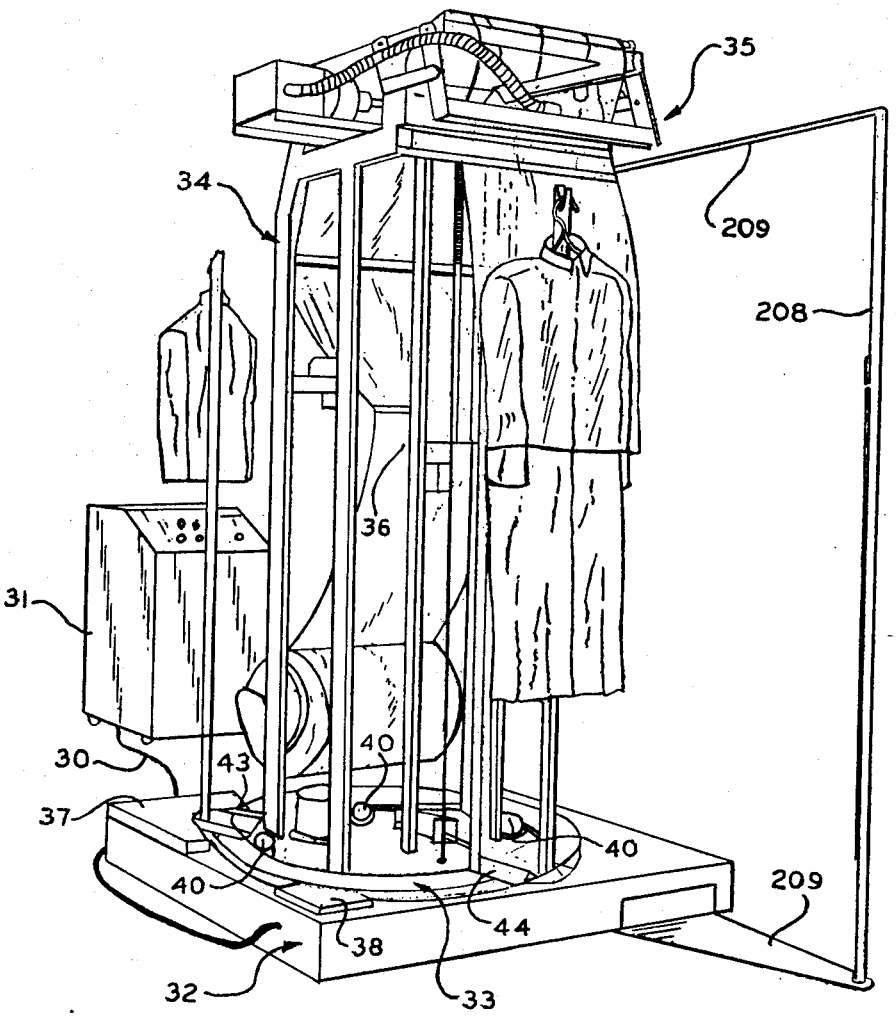
FIG. 1 is a perspective view of the apparatus of the invention, showing the general relative arrangement of the elements thereof.
Figure 2:
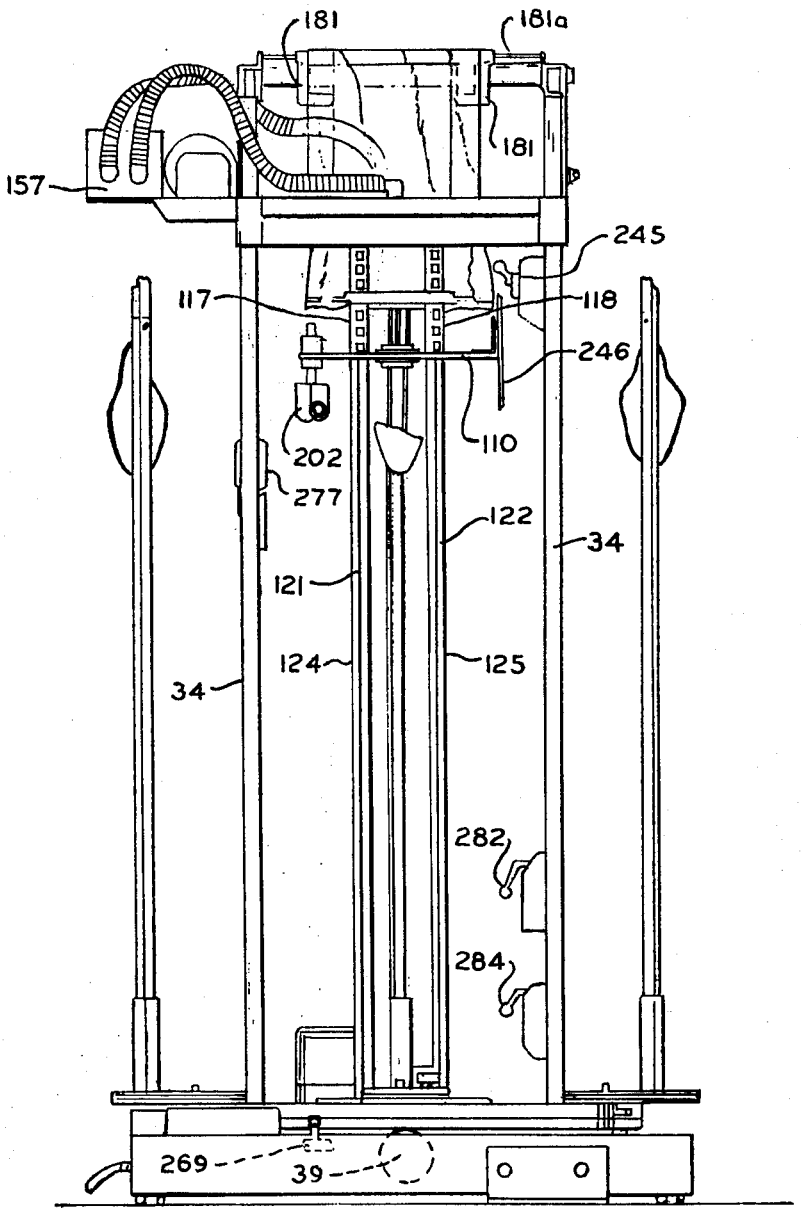
FIGS. 2–5 are elevational views of apparatus of FIG. 1 from the front, right side, rear and left side, respectively.

Horizontally disposed upper support plate 110 (FIG. 10) is attached to frame 34 and holds electric motor 111, attached through suitable gears to drive shaft 112. The latter holds three sprocket wheels 113, 114 and 115, around which pass chains 116, 117 and 118, respectively. Chain 116 passes around a similar sprockett wheel (not shown) on drive roll 97 to effect rotation thereof as material 93 is to be supplied. Chains 117 and 118 each pass through openings in support plate 110 and are each attached at one end to the upper side of plate 120 of carriage portion 36. Attached to the lower side, directly opposite the chain attachments, are cables 121 and 122 (FIG. 2). The cables pass around pulleys located under the central part of base portion 32, one of the pulleys being shown in the sectional view of FIG. 11 and designated by the reference numeral 123. Cable 121 is attached to chain 117 and cable 122 to chain 118 to form endless loops for transporting carriage portion 36 up and down as drive shaft 112 is rotated in opposite directions.

Hollow chain guides 124 and 125 are provided for the respective chains 117 and 118, the guides extending vertically between base 32 and upper support plate 110. Guide 124, as shown in FIG. 11, includes an elongated opening on the lower part of the roar side. Extending through this opening are latch member 126 and arm 127 of switch 128. Stop 129 is frictionally secured to cable 121 and is engaged by latch member 126 as shown to prevent movement of the stop as cable 121 moves upward during downward movement of carriage 36, until the latch is released by actuation of solenoid 130. That is, cable 121 will slide through stop 129 when movement is prevented by other means, but will carry the stop through the frictional engagement when movement is not restricted. Upward movement of stop 129, after release of latch 126, will eventually engage arm 127 and actuate switch 128, with results described later. The vertical position of switch 128, and thus the amount of travel of carriage 36 from the release of latch 126 to the actuation of switch 128, may be adjusted as desired by virtue of the mounting of the switch on base plate 131 which is adjustably attached to slotted bracket 132.

Upper support plate 110 also holds actuating cylinder 133, a pneumatic cylinder which may be driven in either direction by control of an air supply from an appropriate compressed air source by means of valve 134. Rod 135 extends from cylinder 133 and is connected, through linkage 136 to rod 137 to impart rotation thereto in response to clyinder movement. As seen in FIG. 12, plate 138 is fixedly secured to rod 137 for rotation therewith and arm 139 is loosely mounted on rod 137. Arm 139 is rotated by sufficient movement of plate 138 to bring either of pins 140 and 141 into contact therewith.

Slotted end 144 of arm 139 embraces flat bar 145 from which extend rods 146 and 147. These are respectively pivoted at the ends opposite bar 145 to links 148 and 149 (seen also in FIG. 10), which in turn are connected to links 150 and 151, respectively. Pins 152 and 153 provide pivoted mountings for links 148 and 149 at mid-points thereon. As indicated by the arrows on FIG. 12, rotation of bar 137 will rotate plate 138 to bring pin 140 into contact with arm 139. Continued rotation of bar 137 will then move end 144 of the arm to cause rods 146 and 147 to move the ends of links 148 and 149 to which they are attached in the rearward direction indicated by the arrows. The ends of links 148 and 149 on the opposite sides of the pivoted mountings will move in the opposite direction, thereby moving links 150 and 151 forwardly. Supported between links 150 and 151 is plate 155 having toothed cutting edge 156. Thus, a rearward stroke of cylinder 133 will result in a forward, cutting movement of edge 156, which will sever material 93 in a manner described later. Forward movement of cylinder 133 will cause reverse movement of all the elements, restoring plate 155 and cutting edge 156 thereof to the retracted position. A cross-sectional view of material 93, having pleats or gussets 93*a* along each side thereof, is shown in FIG. 12*a*.

The ends of rotatable bar 137 are supported on opposite sides of the uppermost portion of frame 34. Rotation of bar 137 through the action of cylinder 133, besides effecting the previously described cutting movement of the material severing means, also serves to effect reciprocating movement of one of a pair of opposing elements which engage opposite sides of material 93. The face of the movable element is shown in FIG. 13 and the stationary face in FIG. 14. Tube 158 connects vacuum motor 157 to a hollow, interior portion with which a plurality of small openings 159 in face plate 160 communicate. Likewise, tube 161 connects the vacuum motor to an enclosed space behind face plate 162, having openings 163 therein, on the stationary element. Vaccum motor 157 is mounted adjacent carriage motor 111 and may comprise an ordinary household vacuum cleaner motor.

Lower face 164 on the movable element is resiliently mounted on a plurality of springs 165 and includes a series of openings 166 in registration with two sets of conical prongs 167. The prongs of each set extend from a common base of electrically conducting material and individually comprise a conducting core covered with a non-conductive, non-stick coating, preferably of Teflon, or the like. Each set of prongs is connected by wires 168 to an electrical supply and are thereby heated. For a clear showing of at least a portion of all pertinent elements, lower face 164 is broken away so that only one set of openings 166 and prongs 167 are shown. It will be readily understood, however, that both the prongs and openings are duplicated on each side of the movable element. The fixed element of FIG. 14 includes a lower face portion 170 of resilient material, such as sponge rubber, with a pair of elongated slots 171 cut therein.

Details of constructions and operation of the swing bar portion of sealing-cutting unit 35 re shown in FIGS. 15–17. Rod 137, rotation of which by cylinder 133 was explained in connection with FIG. 12, has end portions supported by frame 34. One of the ends is seen in FIGS. 15–17, secured by nut 172 to arm 173 to effect rotation thereof in response to the aforementioned actuation of cylinder 133. Link 174 is pivotally connected at one end to arm 173 by pin 175. The other end of link 174 includes elongated slot 176 through which pin 177 slidingly extends. Pin 177 is fixedly attached to arm 178, pivotally mounted by bolt 179 of frame 34. Arm 178 carries the movable sealing-cutting element shown in FIG. 13, and is biased toward arm 173 by spring 179 which engages pins 175 and 177. The fixed sealing-cutting element of FIG. 14 is mounted on a portion of frame 34.

In FIG. 15, rod 137 has been rotated to the limit of its movement in a counterclockwise direction, thereby rotating arm 173 and 178 in the same direction, and holding the opposing faces of the fixed and movable sealing-cutting elements in spaced relation. Material 93 extends over drive roll 97 andis engaged on opposite sides by face plates 160 and 162, and the previously described vacuum means maintains end 180 of the material in an open condition. Bag pulling means which will be described presently are then inserted in open end 180 and move into engagement therewith which pulls the material free of the vacuum engagement to allow it to be pulled down freely over the garment.

After the material has been pulled down to a desired positino, movement thereof is automatically stopped in a manner explained latter, and cylinder 133 is actuated to rotate rod 137 in a clockwise direction. Thus, the opposing faces of the movable and fixed sealing-cutting elements are brought into engagement with material 93 therebetween, as shown in FIG. 16. Lower face 164 of the movable element contacts the material first and is retracted by compression of springs 165 until upper face 160 engages the material. Prongs 167 will thereby be forced through openings 166 and will pierce material 93, being received in open slots 171 of resilient face 170. At this point, pin 140 engages arm 139 of the cutting mechanism (FIG. 12) and begins to advance knife edge 156 as rod 137 continues to rotate. Such continued rotation moves arm 173 to the position shown in FIG. 17, while expanding spring 180 and bringing the far end of slot 176 into engagement with pin 177. Knife edge 156 is meanwhile advanced completely through material 93, the severing action being facilitated by the firm engagement of the material between faces 160 and 162 immediately above the knife edge and faces 164 and 170 immediately below. The piercing of the thermosensitive material by heated prongs 167 results in a perforated heat seal in the two elongated areas of the prong elements with an opening therebetween. The reverse action of cylinder 133 will counter-rotate rod 137 and move the elements of sealing-cutting unit 35 back to the position of FIG. 15. The vacuum is continuously applied while the material is engaged between faces 160 and 162, thereby opening the end formed by severing the material, and the sealed end below the cut-off will continue to be pulled downward until it reaches the top of the garment. An important detail in preventing the opposing sides of material 93 from sticking together when the vacuum faces are moved apart is the provision of arms 181 having end portions extending inwardly between the gusseted sides 93*a* of the bagging material as it extends over drive roll 97. Arms 181 are best seen in FIG. 2, supported on fixed rod 181*a*, being omitted from FIGS. 15–17 which are intended to show only the action of the sealing-cutting unit.

As previously mentioned, while end 180 is held open by the vacuum means, bag pulling means are inserted therein. Such means are mounted on plate 120 of vertically traveling carriage 36 and comprise double-acting cylinder 182 having U-shaped arms 183 on the ends of the cylinder rods. The arrangement illustrated in the other Figures of the present disclosure is that shown in FIG. 18, while alternate embodiments are shown in FIGS. 19 and 20. Cylinder 182 is supported in spaced relation to plate 120 by mounting rods 184 with the ends of arms 183 extending forwardly, beyond front edge 185 of plate 120. Lines 186 are connected from the compressed air supply to the interior of the cylinder to cause arms 183 to move simultaneously outwardly and inwardly from the ends of the cylinder in response to actuation of solenoid operated four-way valve means 187 (FIG. 3).

In the embodiment of FIG. 19, cylinder 182 is again double-acting, but rather than having arms 183 integral with the cylinder rods they are pivotally attached at 188 to plate 120 of the carriage. Cylinder rods 189 are then pivotally attached to arms 183 intermediate of the pivotal mountings and U-shaped ands thereof. The pivotal attachments 190 of rods 189 to arms 183 are adjustable to vary the positions of the ends of the arms without changing the stroke of the cylinder. This facilitates adjustments for different widths of material 93 and could be used in applications where the use of bagging material of different widths is anticipated. The FIG. 20 embodiment employs a single-ended cylinder 192 with a rod 193 pivotally attached at 194 to a pair of intermediate arms 195. Each of the latter are pivotally connected at 196 to arms 183 which in turn are pivotally mounted on plate 120. This embodiment combines the simpler action of a single-ended cylinder with the adjustable arm position feature of the FIG. 19 embodiment, pivotal mounting 194 being adjustable by providing additional openings in arms 195 as indicated.

Returning now to FIG. 18, carriage 36 is shown in its uppermost position with arms 183 and cylinder 182 insides open end 180 of the bagging material. Arms 183 are initially in the retracted position as they are moved upwardly. After carriage 36 is stopped at the top of the travel cylinder 182 is actuated to move arms 183 outwardly to engage the inside of material 93 firmly and hold end 180 in an open, essentially rectangular position. Portions of sealing-cutting unit 35 by which end 180 would be initially engaged in this position are not shown in order to illustrate more clearly the structure and operation of elements associated with the bag pulling mechanism.

After end 180 is engaged by arms 83 and the vacuum engagement released, motor 111 is actuated to begin movement of chains 116, 117 and 118. Chain 116 rotates drive roll 97 to feed material 93 from the roll and movement of chains 117 and 118 commences the downward travel of carriage 36. The carriage is guided by vertical column 198 which passes through collar means 199 on plate 120. Rotation of carriage 36 about column 198 may be prevented by a keyway, ball-and-groove, or other conventional means. This downward travel draws open end 180 over garment 200, suspended on hanger 201 which is engaged on the notched upper end of pole 51. The elements are so dimensioned and arranged that with slider plate 48, on which pole 51 (FIG. 6) is supported, in the inner position, after retraction of cylinder rod 54, forward edge 185 of plate 120 and cylinder 182 clear the back of pole 51 (behind the garment); garment 200, cylinder 182 and arms 183, as well as pole 51 are enclosed by material 93.

Electric eye unit 202 is mounted on plate 120 in a vertically adjustable manner by means of rod 203 which passes slidably through collar 204 and is retained in the desired position by set screw 205. Unit 202 is of a type in general commercial use containing both a light source and a shielded photocell adapted to actuate a switch upon reflection of light from the source within the unit. In FIGS. 1, 3, 5 and 6 is shown a vertical post 208 held in spaced relation to the main part of the apparatus by supports 209. Reflecting strip 210 is attached to the side of post 208 facing the apparatus and is thus adapted to reflect light from the source within unit 202 back to the photocell within the same unit. Garment 200 will block the path of such light until unit 202 moves downwardly a sufficient distance for the light beam to clear the bottom of the garment, as in FIG. 21. The switch actuated by electric eye unit 202 serves to interrupt the power supply to motor 111, thereby stopping carriage 36 in the position of FIG. 21. Also, the valve controlling the air supply to cylinder 133 is actuated and the previously described sealing-cutting cycle takes place. When material 93 has been sealed and cut, an individual bag, closed at the sides and top and open at the bottom, has been formed. The upper edge of the bag will be free and a new open end of material 93 held by the separated elements of sealing-cutting unit 35. Motor 111 is then actuated again to continue the downward travel of carriage 36 until the top of the bag is brought down to the garment, as shown in FIG. 22. The central opening in the top of the bag, between the heat seal areas, allows the end of pole 51, as well as the hooked end of hanger 201, to extend out of the bag although a portion of pole 51 will be enclosed thereby.

At the end of the downward travel of carriage 36, arms 183 are moved back to their inner or retracted position. Cylinder 55 is then actuated to move slider plate 48 and pole 51 back to the outer radial position on table 42, pulling the bag off of cylinder 182 and arms 183. Indexing pawl 67 and shock absorber 68 are then pivoted to allow rotation of table 33 by 120°, the upper end of pole 51 clearing the elements of sealing-cutting unit 35 since the pole is in its outer radial position. Motor 111 is then actuated for reverse operation and chains 117 and 118 pull carriage 36 back to its uppermost position. It should be noted that chains 117 and 118 are attached to the top of plate 120 in line with the center of column 198, thereby avoiding twisting or binding as the carriage travels. Although drive roll 97 is also driven by chain 116 in reverse direction, this has no effect on material 93 since there is no tension on the material. That is, drive roll 97 tends to advance material 93 only during downward movement of carriage 36 when engagement of the material by arms 183 tends to maintain it in frictional engagement with the drive roll.

In FIG. 23 is shown the mechanism for automatically removing the bagged garments from the poles at discharge station D (also partially shown in FIGS. 3 and 4). Elongated pneumatic cylinder 212 is attached by bracket 213 to frame 34 and by line 214 at its lower end to the compressed air supply. Piston 215 carries rod 216 which extends out of the upper end of cylinder 212. Plate 217 is fixed to the upper end of the piston rod and is formed with arm portion 218 extending to a position closely adjacent the upper end of a garment pole 51 at the discharge station with the upper edge of arm 218 below the bottom of the notch in the pole. A bell crank lever is pivotally mounted on plate 217 by pin 220 intermediate of its two legs 221 and 222. The upper end of leg 222 is connected by rod 223 to slider 224 on arm 218. The bell crank is biased for rotation in a clockwise direction as seen in FIG. 23 by spring 225 connected between leg 221 and a fixed pin on plate 217. The limit of clockwise movement of the bell crank is defined by contact of slider 224 with plate 217. Also attached to leg 221 is elongated rod 227, extending downwardly into tube 228 and carrying stop 229 near its lower end.

When pole 51 carrying a garment on a hanger is at the discharge station, arm 218 will extend below the end of the hanger hook. Admission of pressurized air to the lower end of cylinder 212 will move piston 215, and thereby rod 216 and the elements mounted thereon upwardly with arm 218 lifting the hanger off the end of pole 51. The bag formed of material 93 encircles the pole, as previously explained, and therefore the bottom of the bag must be lifted clear of the top of the pole.

In the dotted line position of FIG. 23 the elements are shown at the upper end of the travel, defined by contact of stop 229 with the upper end of tube 228. Upon such contact movement of rod 227, and thereby the end of leg 221 of the bell crank to which it is attached, stops and continued upward movement of piston 215 causes counterclockwise rotation of the bell crank. This moves rod 223 and pushes slider 224 toward the end of arm 218. In so moving, slider 224 pushes the hooked end of the hanger off arm 218 and onto the end of a downwardly inclined receiving rod 230. Since the bag has been removed from pole 51, the hanger carrying the bagged garment may slide freely down rod 230 to a conveyor or any other desired receiving means for finished product. The position of stop 229 is preferably adjustable on rod 227, e.g., by being threaded thereon or secured by a set screw accessible through cut-out 231 in tube 228, to allow selective changes in the vertical position at which the hanger is ejected from arm 218. As table 33 is indexed another increment to move the pole from which the garment has just been removed back to the loading station L to receive another unbagged garment, the pressurized air is released from cylinder 212, allowing the elements to drop rapidly to the lower position and positioning arm 218 to pick up the hanger from the next garment pole to reach the discharge station. Appropriate valve means for controlling air flow in and out of cylinder 212 may be provided in conventional fashion and actuated by movement of table 33 or other elements.

Turning now to FIG. 24, electrical operation of the apparatus will be explained, in conjunction with the mechanical movements described previously. The apparatus is designed for operation from a 115 volt AC source, main power switch S1 being provided at the input. Switches preferably located in or on control cabinet 31 will be indicated with the prefix S, being shown only schematically, while those physically illustrated in other Figures are denoted by regular reference numbers. Fuses 240 of appropriate values are provided as indicated, and circuit breakers may be used as required. A 90 volt rectifier 241 is provided for DC components. A pair of manually operable switches are provided on control cabinet 31 for stopping and starting operation of the apparatus. Switch S2 may be opened to stop operation of the machine in any position, i.e., at any point in its operating cycle. Turning switch S3 to the off position will cause the machine to stop only when carriage 36 has reached its uppermost position as explained later. It is this position in which the apparatus is intended to be stopped when not in use, as the vacuum, air and electrical systems may all be shut off with no problems of synchronism, etc., when restarted. A pair of different colored indicator lights 242 may be provided to show the position of S3. Manually operable switches S4 and S5 are also provided on the control cabinet for controlling electrical supply to wire 168 (FIG. 13) of the heat seal mechanism and to vacuum motor 157, respectively. Indicator lights 243 may be provided to show that each is operable.

For purposes of explanation, the beginning of a cycle is assumed to be with carriage 36 at the top of its travel, arms 183 extended within material 93, and cylinder 55 retracted in order to have a garment in position for bagging. Switches and other elements are shown in their respective positions or states at this point in the operation, with the machine running. Downward movement of carriage 36 is initiated by energization of relay K2, the holding circuit of which is wired through the garment length detector unit 202, thereby providing power to carriage motor 111. Relay K2 will be energized upon movement of carriage 36 to its uppermost position assuming switch S2 to be closed, and S3 to be on, as shown, as explained more fully at the end of the operating cycle description. As previously described, when the carriage has traveled a sufficient distance that the light beam from unit 202 is no longer intercepted by the garment it is reflected by strip 210 back to the unit and serves to open the holding circuit, thereby deactuating relay K2, opening the circuit to motor 111 and stopping downward travel of carriage 36 in the position shown in FIG. 21. An appropriate electrically operated brake, indicated in FIg. 24 by the coil numbered 247, is provided for motor 111, the brake being connected through relays K1, K2 and K3 to be on whenever motor 111 is off, and vice versa.

The holding circuit for relay K2 also maintains solenoid 244 in an actuated condition. Deactuation of this solenoid, preferably located within control cabinet 31, releases an arm which causes movement of switch S6 to the closed position. Switch S6 is connected to the 115V supply through the normally closed contacts of switch 245 (see FIG. 18) which is held by cam plate 246 on the normally open contacts (i.e., the position in which the switch is shown in FIG. 24) only when carriage 36 is at the top of its travel. The current through switch S6 is provided to transformer 248, and thus to coil 249 of solenoid-operated four way air valve 134 (FIG. 10) to provide an air supply for moving cylinder 133 (FIGS. 10, 12) in an inward direction. This rotates bar 137 in the manner previously described, thereby operating the sealing-cutting unit. At the extreme inward end of its travel, cylinder 133 rotates bar 137 to a position wherein arm 252 (FIG. 12) actuates switch 251 to provide current to a time delay relay 250. After an appropriate (adjustable) delay, allowing time for the sealing-cutting action to take place, relay 250 provides current to transformer 254, and therefore to coil 256 to again actuate air valve 134 to reverse the air supply and move cylinder 133 back in an outward direction.

As bar 137 counter-rotates, arm 252 rides over and actuates (closes) switch 253. This is a one-way switch which, though contacted in both directions of movement of arm 252, is actuated only during outward travel of cylinder 133. Closing switch 253 provides current to the coil of relay K3, which is self-holding through the normally closed contacts of switches 284 (described later) and 128 (see FIG. 11). This again provides power to motor 111 to resume movement of carriage 36 in a downward direction. Energization of relay K3 provides actuation of counter 257 which is thus incremented once for each full cycle of the machine.

When switch 253 is closed to energize relay K3, current is also provided to solenoid 130 (see FIG. 11) to release latch 126 and allow stop 129 to move with cable 121 as previously described. After movement of stop 129 a predetermined distance, switch 128 is moved by engagement of stop 129 with arm 127, from the position shown in FIG. 24 on the normally closed contact, to normally open contact 258. This breaks the holding circuit of relay K3, thereby removing power from motor 111 and stopping movement of carriage 36.

Movement of switch 128 to contact 258 provides current to transformers 260 and 261, which in turn energize coils 262 and 263, respectively, of two separate 4-way air valves, the former controlling the air supply for cylinder 55 and the latter the air supply for cylinder 182. Thus, rod 54 is moved outwardly to position garment pole 51 in the outer position as arms 183 are moved inwardly to release their engagement with the lower interior of the bag. The elements are in the position shown in FIG. 22 with carriage 36 in its lowermost position, the garment fully bagged, the bagging maaterial released and the pole moving outwardly.

During movement of cylinder 55 to the extended position of rod 54, rod 57 is also moved to release end portion 60 thereof from engagement with switch 62 and to trip switch 61. Although switch 61 is closed only momentarily, it will actuate an air valve arranged to energize both of solenoids 72 and 88, the entire mechanism being denoted in FIG. 24 by the reference numeral 265. Movement of index pawl 67 and shock absorber unit 68 in response to actuation of their respective solenoids frees table unit 33 for rotation. Such rotation begins substantially at once since switches 77 and 78 are moved by release therefrom of block 80 to complete a circuit to coil 267, serving to engage the clutch of table motor 90. Closing of switch 61 also actuates relay K5, which is selfholding through the normally-closed contacts of switch 269, thereby maintaining index pawl 67 and 68 in the outward, or disengaged, positions after switch 61 opens.

Switch 269 is mounted on base portion 32 (see FIGS. 2 and 6) and has an actuating arm extending into the path of travel of stops 63, 64 and 75 as table 33 rotates. By the time one of the stops moves switch 269 from the position shown in FIG. 25 to the opposite contact, table 33 has rotated a sufficient distance that the garment just bagged has been moved clear of the side of carriage unit 36. Movement of switch 269 to the normally open contact serves to break the circuit to relay K5, thereby deactuating mechanism 265 and allowing index pawl 67 and unit 68 to move back to the inward positions for engagement with the next stops. Also, such movement of switch 269 actuates relay K1 which has a self-holding circuit through the normally open contacts of switch 245. The connections through the contacts of relay K1 with carriage motor 111 are opposite to those of K2 and K3, whereby the motor runs in reverse direction and carriage 36 is moved upwardly.

Table 33 continues to rotate until the stops contact shock absorber unit 68 and index pawl 67, thereby moving switches 77 and 78 back to their original positions. This breaks the circuit to coil 267 and disengages the clutch of table motor 90. When carriage 36 reaches its uppermost position, com plate 246 will move switch 245 back to the position shown in FIG. 24, thereby breaking the circuit to relay K1 and stopping carriage motor 111. At substantially the same time, com plate 246 rides and closes another switch 271, thereby completing a circuit from transformer 273 to coil 275 of the solenoid operated air valve for cylinder 182. The cylinder and bag grasping arms 183 have been moved inside open end 180 (FIG. 15) of the bagging material with arms 183 in the inner or retracted position, and closing switch 271 causes movement of the arms back to the outer, extended position wherein the ends of the arms firmly engage the interior of the open end of the bagging material. This will pull the material loose from its engagement by faces 160 and 162 of the vacuum means, whereby the vacuum may be applied continuously and need not be turned off and on for each cycle.

Movement of switch 245 back to the position shown in FIG. 24 when carriage 36 approaches the upper limit of its travel actuates relay K4. The contacts of relay K4 connect switch S3 with a second electric eye unit 277, identical in construction and operation to unit 202 but mounted in a stationary position on frame 34, as shown in FIGS. 2 and 5. The contacts of unit 277 remain closed whenever the path of the light beam is broken by the presence of a garment at bagging station B. In other words, unit 277 serves as an interlock device, stopping operation of the machine when no garment is present on the pole which is positioned at the bagging station. Assuming a garment to be present, a circuit will be completed from the 115V supply through switch 78, unit 277, relay K4 and switch S3 to transformer 279, thereby energizing coil 281 of the air valve controlling movement of cylinder 55. When the latter arrives at its fully retracted position, the next garment pole has been moved into position for bagging of the garment supported thereon and switch 62 is moved to the closed position by contact therewith of end portion 60. This completes the circuit to relay K6, thereby disengaging brake 247 of carriage motor 111 and allowing carriage 36 to begin downward travel on a new cycle.

A pair of momentary contact, push-button type switches are provided on control cabinet 31 to allow the operator to bypass the normal operating circuits and move the sealing-cutting unit swing bar or the table index pawl and shock absorber independently of operation of the rest of the machine. Such switches are indicated in FIG. 24 by the boxes numbered S7 and S8. Safety limit switches 282 and 284 are shown in FIG. 2 attached to frame 34 for contact by cam plate 246 should carriage 36 tend to overtravel due to inadvertent blocking of the light from unit 202 after the beam has passed the bottom of the garment, while the motor is driven through relay K2, or due to other malfunction while driven through relay K3.

What is claimed is:

1. Apparatus for automatically applying bags, closed at the sides and one end and open at the other end, to items in a continuous sequence, said apparatus comprising:

a. a plurality of support means for holding said items;

b. support advancing means operable to move said support means sequentially from a loading station, to a bagging station, to a discharge station, and thence back to the loading station; and c. bagging means operable to apply an individual bag on each item as it is positioned at said bagging station.

2. The invention according to claim 1 and further including apparatus for sealing together two layers of thermosensitive material from which said bags are formed to close said one end thereof, said sealing means comprising:

a. an elongated bar having a row of conical prongs extending therefrom;
b. said bar and prongs being of heat conducting material, and said prongs being covered with a non-conducting, non-stick coating;
c. means for engaging and holding the two layers together;
d. means for maintaining said bar and prongs at a sealing temperature with respect to the thermosensitive material; and
e. means for moving the ends of said prongs through the two layers of material.

3. Apparatus according to claim 1 wherein said support means comprise vertically disposed poles upon which the items are suspended.

4. Apparatus according to claim 3 and further including automatic discharge means operable as each of said poles is positioned at said discharge station to remove the items from the poles.

5. Apparatus according to claim 3 wherein said support means are positioned on a rotatable table and said advancing means comprises means for rotating said table.

6. The invention according to claim 5 and further including automatically operable indexing means for stopping rotation and fixing the position of said table with one of said support means in each of said loading, bagging and discharge positions.

7. The invention according to claim 1 and further including means rendering said apparatus inoperative in the absence of an item at said bagging station.

8. The invention according to claim 1 wherein said engaging means comprise opposing surfaces on a pair of members relatively movable toward and away from one another, said prongs being arranged on the side on one of said members opposite said opposing surface thereof and movable with respect to said one member to extend through one or more openings therein, thereby moving said prongs through the layers of material as the latter are engaged between said opposing surfaces.

9. The invention according to claim 8 wherein the member opposite said one member includes one or more openings arranged in registration with said openings in said one member when the two are moved toward one another to receive the ends of said prongs extending through the layers of material.

10. The invention according to claim 8 wherein at least one of said members is formed of resilient material.

11. The invention according to claim 2 wherein the material is in flat, tubular form, the seal is effected transversely, between the closed sides, and further including means for transversely severing the material adjacent to the seal, thereby forming an individual bag, closed at the sides and one end.

12. Apparatus for automatically applying a bag of thermosensitive plastic, supplied in the form of a continuous, tubular web, to a garment supported on a hanger, said apparatus comprising:

a. means positioning the leading end of the web above the garment;
b. means engaging the leading end and holding it open;
c. means for moving the web downwardly over the garment with the leading end engaged and held open by said engaging means;
d. means sensing the length of the garment and stopping downward movement of the web with the leading end in predetermined relation to the lower end of the garment;
e. means for effecting a transverse heat seal of the web above the garment;
f. means for severing the web adjacent said heat seal on the side opposite the garment, thereby providing an individual bag closed at the top and sides, and open at the bottom; and
g. means for resuming downward movement of the individual bag to bring the top thereof down to the top of the garment.

13. Apparatus according to claim 12 wherein said sensing means comprise a light beam and photoelectric cell.

14. Apparatus according to claim 12 wherein said means for moving the web comprise a vertically reciprocal carriage upon which said engaging means and said sensing means are mounted.

15. In apparatus for engaging and opening the leading end of a continuous web of flexible material in tubular form, folded flat with side gussets, the improvement comprising:

a. a pair of members having opposing, essentially flat faces relatively movable between spaced and engaged positions;
b. means for applying a vacuum effective over at least a significant portion of each of said faces;
c. means for moving the material between said members when the latter are in said spaced position;
d. means for moving said members to said engaged position with the material therebetween;
e. means for transversely severing the material adjacent one side of said faces, thereby forming a leading end of the material;
f. a pair of arms having end portions extending into said side gussets adjacent the other side of said faces;
g. means for moving said members to said spaced position with the vacuum applied to said faces, thereby opening said leading end; and
h. sealing means movable with said members and effecive when the latter are in said engaged position to effect a seal transversely across the material adjacent to the position where the material is severed and on the side thereof opposite said faces.

16. Apparatus for automatically applying a bag, closed at the sides and one end, to an item supported at a bagging station, the bagging material being supplied in tubular form from a continuous web, said apparatus comprising, in combination:

a. means for engaging and holding the leading end of said web in open condition;
b. a vertically reciprocally movable carriage driven by a motor and carrying said engaging means for moving said open end downwardly over the item;
c. means for effecting a seal transversely of said web at a distance from said leading end in predetermined relation to the length of the item;
d. means for severing said web transversely, adjacent the area of said seal, thereby forming an individual bag from the severed portion and a new leading end for movement over the next item;

e. automatic stop means to halt downward travel of said carriage at an intermediate position in said travel;

f. means for actuating said sealing and severing means in response to halting of said carriage at said intermediate position; and g. means for releasing said engaging means from said open end of the individual bag.

17. Apparatus according to claim 16 and further including first automatic starting means for resuming downward travel of said carriage from said intermediate position in response to completion of the action of said sealing and severing means, and second automatic stop means to halt movement of said carriage at a predetermined lower terminal position.

18. Apparatus according to claim 17 and further including second automatic starting means for initiating upward movement of said carriage from said lower terminal position, and third automatic stop means to halt movement of said carriage at a predetermined upper terminal position.

19. Apparatus for automatically applying, in a continuous sequence, individual bags of thermosensitive plastic, supplied in the form of a continuous, tubular web, to a succession of garments supported on hangers and supplied to said apparatus one at a time, said apparatus comprising:

a. at least one elongated pole having a supported lower end and an upper end adapted to receive and support the hooked end of a garment hanger;

b. means for moving at least said upper end laterally between three distinct positions in a continuous sequence;

c. means positioning the leading end of the web above one of said three positions;

d. means automatically operable to move said leading end downwardly in response to presence of a garment on a hanger supported on said pole when the latter is in said one position, with the tubular web enclosing the garment; and e. means automatically operable to transversely seal and cut the web, thereby forming an individual bag and a new leading end of said web.

20. In an apparatus for wrapping bulky objects or stacked groups of objects in packaging foils including a conveyor device for conveying the objects into the apparatus for temporary arrest therein, and a feed device for a continuous length of foil tubing, the improvement comprising means for engaging the leading end of the infed foil tubing, for opening this end to a cross-section greater than the corresponding area of the objects on the conveyor device, and for transporting the opened end of the tubing a preselectable amount over said objects, and including a foil transverse welding and severing device arranged after said feed device and having means for applying a transverse seam to the foil tubing above said objects and for severing said tubing above this transverse seam, control means for controlling said transporting means for performing the transporting operation in two steps, and for operating the transverse welding and severing device between these two steps for the application of the transverse welding seam and the severing of the foil tubing.

21. Apparatus according to claim 20 and further including a first switch operable to stop said transporting means after the first step of the transporting operation and a second switch operable by the transporting means on completion of the second step of the transporting operation to effect the termination of said operation.

22. Apparatus according to claim 20, in which said means engaging the leading end of the infed foil tubing comprises two parallel bars with suction openings connected to a suction pump.

23. Apparatus for automatically applying a bag, closed at the sides and one end, to an item supported at a bagging station, the bagging material being supplied in tubular form from a continuous web, said apparatus comprising, in combination:

a. means for engaging and holding the leading end of said web in open condition said engaging means comprising members movable between a retracted position, wherein said members may be inserted in said leading end, and an extended position, wherein said members firmly engage the interior of the bagging material, said members being so constructed and arranged that said leading end is thereby held in open condition;

b. power driven means for moving said open end over the item;

c. means for effecting a seal transversely of said web at a distance from said leading end in predetermined relation to the length of the item;

d. means for severing said web transversely, adjacent the area of said seal, thereby forming an individual bag from the severed portion and a new leading end for movement over the next item; and e. means for releasing said engaging means from said open end of the individual bag.

24. Apparatus according to claim 23 wherein said members comprise a pair of U-shaped arms movable by a pneumatic cylinder.

25. Apparatus according to claim 24 wherein said cylinder is mounted on and movable with said power driven means.

26. Apparatus for automatically applying a bag, closed at the sides and one end, to an item supported at a bagging station, the bagging material being supplied in tubular form from a continuous web, said apparatus comprising, in combination;

a. means for engaging and holding the leading end of said web in open condition;

b. power driven means for moving said open end over the items;

c. means for effecting a seal transversely of said web at a distance from said leading end in predetermined relation to the length of the item;

d. means for severing said web transversely, adjacent the areas of said seal, thereby forming an individual bag from the severed portion and a new leading end for movement over the next item; and e. means for releasing said engaging means from said open end of the individual bag.

27. Apparatus according to claim 26 wherein said power driven means comprise a reciprocally movable carriage driven by a motor and carrying said engaging means.

28. Apparatus according to claim 27 wherein said carriage is vertically reciprocal to move said engaging means, and thereby said open end, downwardly over the supported item and said power driven means are reversible to move said carriage upwardly after release of said engaging means from the individual bag.

29. Apparatus for automatically applying a bag of thermosensitive plastic, supplied in the form of a continuous, tubular web, to a garment supported on a hanger, said apparatus comprising:

a. means positioning the leading end of the web above the garment;

b. means engaging the leading end and holding it open;

c. means for moving the web downwardly over the garment with the leading end engaged and held open by said engaging means;

d. means sensing the length of the garment and stopping downward movement of the web with the leading end in predetermined relation to the lower end of the garment;

e. means for effecting a transverse heat seal of the web above the garment; and f. means for severing the web adjacent said heat seal on the side opposite the garment, thereby providing an individual bag closed at the top and sides, and open at the bottom.

* * * * *